US007442888B2

(12) United States Patent
Puddicombe, II et al.

(10) Patent No.: US 7,442,888 B2
(45) Date of Patent: Oct. 28, 2008

(54) SAFETY LOCK FOR INTERLOCK SWITCH

(75) Inventors: Richard J Puddicombe, II, Redwood City, CA (US); Joseph David Borjon, Livermore, CA (US)

(73) Assignee: Scientific Technologies Incorporated, Fremont, CA (US)

( * ) Notice: Subject to any disclaimer, the term of this patent is extended or adjusted under 35 U.S.C. 154(b) by 26 days.

(21) Appl. No.: 11/465,900

(22) Filed: Aug. 21, 2006

(65) Prior Publication Data

US 2007/0039806 A1 Feb. 22, 2007

Related U.S. Application Data

(60) Provisional application No. 60/710,227, filed on Aug. 22, 2005.

(51) Int. Cl.
*H01H 9/28* (2006.01)

(52) U.S. Cl. ..... 200/43.04; 200/43.11; 200/43.14; 200/43.15

(58) Field of Classification Search ... 200/43.01–43.07, 200/43.09–43.16, 43.18–43.21, 61.62, 61.66, 200/334, 50.02, 50.11, 321, 322, 333; 70/14, 70/18, 19, 58, 30, 49
See application file for complete search history.

(56) References Cited

U.S. PATENT DOCUMENTS

| | | | | | |
|---|---|---|---|---|---|
| 1,197,020 | A | | 9/1916 | Farrar | |
| 3,666,259 | A | | 5/1972 | Kotting | |
| 4,200,774 | A | * | 4/1980 | Nelms | 200/43.08 |
| 4,733,029 | A | * | 3/1988 | Kobayashi et al. | 200/43.15 |
| 4,864,834 | A | | 9/1989 | Waite | |
| 4,897,515 | A | * | 1/1990 | Zubar et al. | 200/43.14 |
| 5,020,342 | A | | 6/1991 | Doan et al. | |
| 5,167,135 | A | | 12/1992 | Gobeski | |
| 5,365,757 | A | | 11/1994 | Primeau | |
| 5,732,575 | A | * | 3/1998 | Kaveney | 70/2 |
| 5,881,582 | A | | 3/1999 | Monaco | |
| 5,909,019 | A | * | 6/1999 | Maloney et al. | 200/43.14 |
| 6,268,574 | B1 | | 7/2001 | Edens | |
| 6,310,305 | B1 | * | 10/2001 | Kamino et al. | 200/43.11 |
| 6,388,213 | B1 | * | 5/2002 | Letient et al. | 200/43.15 |

(Continued)

FOREIGN PATENT DOCUMENTS

| | | |
|---|---|---|
| DE | 8120397 | 10/1981 |

(Continued)

*Primary Examiner*—Michael A Friedhofer
(74) *Attorney, Agent, or Firm*—Coats & Bennett, P.L.L.C.

(57) ABSTRACT

A safety lock as taught herein comprises first and second members and is configured to lockably mount to an interlock switch. In one or more embodiments, the second member slidably couples to the first member and slides between a disengaged position that allows for mounting and an engaged position that engages a corresponding switch actuator opening in the interlock switch. In at least one embodiment, the second member projects through an opening in the first member into engagement. The first and second members may include corresponding lock openings, allowing the second member to be locked into the engaged position. In at least one embodiment, the first member conforms at least partially to the exterior of the interlock switch, e.g., it spans at least one exterior corner of the interlock switch. The first member may include an engagement finger to engage a corresponding switch actuator opening of the interlock switch.

19 Claims, 6 Drawing Sheets

U.S. PATENT DOCUMENTS

| | | | | |
|---|---|---|---|---|
| 6,396,008 | B1 * | 5/2002 | Maloney et al. | 200/43.14 |
| 6,459,052 | B2 * | 10/2002 | Kajio et al. | 200/43.04 |
| 6,617,532 | B1 * | 9/2003 | Turek | 200/43.14 |
| 6,727,441 | B2 * | 4/2004 | Benda | 200/43.15 |
| 6,791,040 | B1 * | 9/2004 | Puhalla et al. | 200/43.14 |
| 7,223,927 | B2 * | 5/2007 | Poyner | 200/43.04 |

FOREIGN PATENT DOCUMENTS

| | | |
|---|---|---|
| GB | 2377081 | 12/2002 |
| WO | WO 99/56295 | 11/1999 |

* cited by examiner

SAFETY LOCK FOR INTERLOCK SWITCH

RELATED APPLICATIONS

This application claims priority under 35 U.S.C. § 119(e) to U.S. Provisional Application 60/710,227, which was filed on 22 Aug. 2005 and is entitled "Safety Lock for Interlock Switch," and which is incorporated herein by reference.

BACKGROUND

1. Field of the Invention

The present invention generally relates to interlock switches, and particularly relates to a safety lock for interlock switches.

2. Background Information

A common type of safety interlock includes a switch and an actuator. In a common configuration, the actuator includes a finger and the switch includes a slotted head configured to receive the actuator finger. In one arrangement, positive engagement of the actuator finger in the head slot turns the switch on, while disengagement of the actuator finger from the head slot turns the switch off. While it is common for the actuator to have a single finger, the switch head may have more than one slot. For example, there may be one or more switch actuator openings (e.g., slots) on adjacent or opposing faces of the head, allowing the switch to be mounted in different orientations.

For machine guarding applications, the actuator may be mounted to a moveable guard (or access panel, door, gate, etc.), with the switch mounted in a corresponding fixed position such that closure of the guard causes the actuator to engage the switch. While this arrangement provides reliable machine lockout on guard opening, it does not necessarily prevent accidental or mistaken operation of the switch while the movable guard is open.

Safety locks eliminate, or at least greatly reduce, the possibility of accidental reengagement of the safety interlock. In a common safety lock configuration, the safety lock includes a tab that inserts into the switch head slot that would otherwise be engaged by the actuator finger. Such safety locks usually include a moveable piece (e.g., sliding or rotating) that locks the tab into the slot. The moveable piece is then locked into position using a padlock, for example.

Some implementations of the above type of safety lock do not engage with the head slot as securely as merited by the safety-critical nature of the application. For example, some safety locks, even when locked into place, can be disengaged from the switch head by twisting, pulling, or other manipulation.

SUMMARY

In one or more embodiments taught herein, a safety lock is configured to lockably mount to an interlock switch and comprises a first member configured to conform at least partially to a profile of the interlock switch, and a second member lockable to the first member in an engaged position. In its engaged position, the second member engages a first switch actuator opening in the interlock switch. In at least one such embodiment, the second member of the safety lock is slidably coupled to the first member and configured to slide between a disengaged position and the engaged position. Further, in one or more embodiments, the first and second members include corresponding lock openings that are configured to align with each other when the second member is in its engaged position, thereby allowing the second member to be locked into the engaged position.

Further, in one or more embodiments taught herein, the first member of the safety lock comprises one or more plate sections that are bent or otherwise angled to span at least one exterior corner of the interlock switch. For example, a single elongated plate can be bent such that it includes one or more corners, allowing it to span two or more faces of a rectangular interlock switch head. A terminal one of these plate sections of the first member includes or otherwise integrates an engaging finger to engage a second switch actuator opening in the interlock switch. As the first and second switch actuator openings are disposed in different faces of the interlock switch, the safety lock in such configurations engages at least two faces of the interlock switch when mounted to the interlock switch.

In more detail, at least one configuration of the safety lock corresponds to an interlock switch that includes first and second switch actuator openings disposed in first and second faces, respectively, of the interlock switch. In such configurations, a method of safety locking the interlock switch comprises engaging at least two faces of the interlock switch with the first member of the safety lock, which is angled or otherwise bent to wrap around the at least two faces of the interlock switch, and inserting the second member through an opening in the first member. In doing so, the second member engages the first switch actuator opening disposed in a first one of the at least two faces of the interlock switch. Locking the second member to the first member in the engaged position thereby secures the safety lock to the interlock switch.

For further engagement security, the first member may include or otherwise integrate an engagement finger, wherein engaging the first member with the interlock switch includes inserting the engagement finger into the second one of the switch actuator openings. Mounting the safety lock thus comprises positioning the second member in its disengaged position, engaging the second switch actuator opening of the interlock switch with the engagement finger of the first member and seating or otherwise placing the first member into abutting engagement with the spanned faces of the interlock switch. Once the first member is in place, the second member is slid through a slot, notch, or other opening in the first member, and into engagement with the first switch actuator opening, and locked into place via aligned lock openings in the first and second members.

In terms of sliding engagement of the second member, in at least one embodiment taught herein, a safety lock comprises a first member configured to slidably retain a second member. In such configurations, the second member is movable between an engaged position in which the second member engages a first switch actuator opening of an interlock switch, and a disengaged position in which the second member disengages from the first switch actuator opening. Further, in such configurations, the first member may be configured to wrap around at least one corner of the interlock switch.

For example, in one such embodiment, the first member comprises first, second, and third sections. The first section is disposed at one end of the second section and projects perpendicularly away from the second section, and the third section is disposed at the other end of the second section and projects perpendicularly away from the second section in a direction opposite the first section. The third section may be the terminal or ending section of the first member and may include an engagement finger for engaging a switch actuator opening of the interlock switch. However, in at least one embodiment, the first member includes a fourth section perpendicularly extending from an end of the third section, to thereby span another corner of the interlock switch. In such embodiments, the fourth section may include an engagement finger for engaging a switch actuator opening in the interlock switch.

Of course, the present invention is not limited to the above features and advantages. Those skilled in the art will recognize additional features and advantages upon reading the following detailed description, and upon viewing the accompanying drawings.

DETAILED DESCRIPTION OF THE INVENTION

Figure 1:
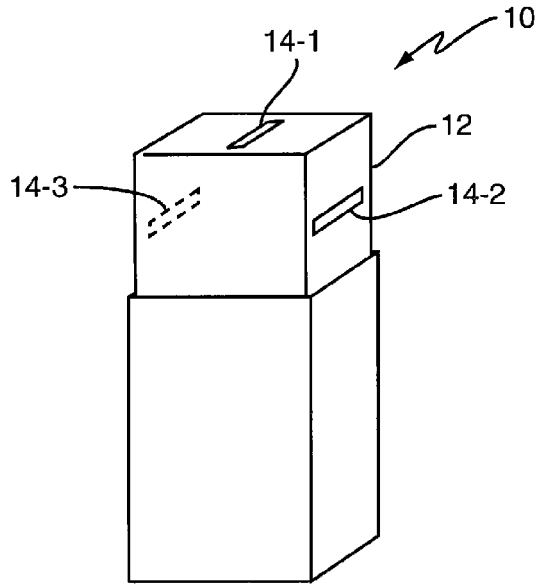
PRIOR ART FIG. 1
FIG. 1 is a diagram of a conventional interlock switch.

FIG. 1 illustrates a conventional safety interlock switch 10. The illustrated switch 10 includes a switch head portion 12 that is substantially rectangular in shape, and that has one or more switch actuator openings 14 (openings 14-1, 14-2, and 14-3) as illustrated. These openings may be formed as horizontal slots, as shown in the illustration. In at least one embodiment of the safety interlock switch 10, one or more switch actuator openings 14 are disposed in each of two or more faces of the safety interlock switch 10.

Regarding such switch actuator openings 14, other slot orientations (such as vertical or angled) may be used, and other opening types, such as circular openings, may be used. In general, it should be understood that the interlock switch 10 can be varied. For example, it may not have as many switch actuator openings as illustrated. Instead, it may have at least one switch head face without a switch actuator opening 14. Further, it may have switch head faces with more than one switch actuator opening 14.

Figure 2:
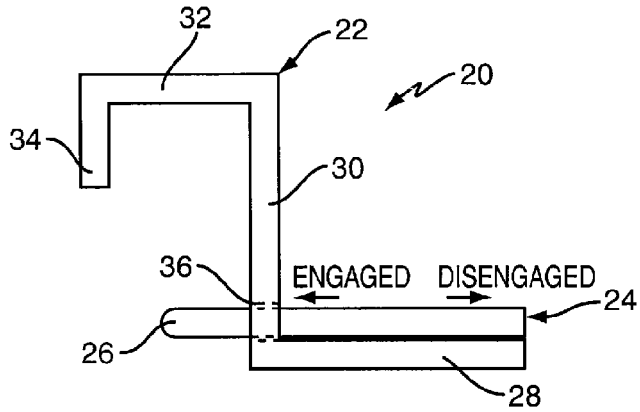
FIG. 2 is a diagram of a side view of one embodiment of the interlock switch safety lock taught herein.

FIG. 2 illustrates one embodiment of a safety lock 20 as taught herein, for mounting to and "locking out" the interlock switch 10. The illustrated embodiment of the safety lock 20 comprises a first member 22 that is configured to conform at least partially to a profile of the interlock switch 10, and a second member 24 that in one or more embodiments is lockable to the first member 24 in an engaged position. As will be explained in more detail, the second member 24 is configured to engage a corresponding one of the switch actuator openings 14 in the interlock switch 10. More particularly, the second member may include an engagement finger 26 adapted for engaging one of the switch actuator openings 14 of the interlock switch 10 when the safety lock 20 is mounted to the interlock switch 10.

Generally, in one or more embodiments, the first member 22 comprises one or more plate sections that are bent or otherwise angled to span at least one exterior corner of the interlock switch 10. In at least one such embodiment, the first member 22 comprises a first section on which the second member 24 is slidably retained, a second section perpendicular to the first section that is configured to abut a first face of the interlock switch 10, and a third section perpendicular to the second section and parallel to the first section that is configured to abut a second face of the interlock switch 10. As such, the first member 22 may comprise a first section, a second section perpendicularly extending from an end of the first section, and a third section perpendicularly extending from an end of the second section, such that the first and third sections are in parallel and perpendicularly extend in opposite directions from respective ends of the second section.

With such configurations, the first member may further comprise a fourth section perpendicularly extending from an end of the third section, such that the fourth section is parallel to the second section and spaced apart from the second section as a function of the third section's length. In any case, a terminal one of these sections, e.g., the third section for three-section embodiments and the fourth section for four-section embodiments, may include an engagement finger configured to engage a second one of the switch actuator openings 14 in a second face of the interlock switch 10, wherein the second member 24 engages a first one of the switch actuator openings 14 in a first face of the interlock switch 10. With these first and second switch actuator openings disposed in different faces of the interlock switch 10, the safety lock 20 engages at least two faces of the interlock switch 10 when mounted to the interlock switch 10.

Turning to the particular details illustrated in FIG. 2, one sees that the first member 22, which may be made from bent, machined, cast, extruded, or joined plates, comprises a first section 28 that continues into a second section 30, which is perpendicular to the first section 28, and which continues into a third section 32. The third section 32 is perpendicular to the second section 30 and, in at least some configurations, includes an engagement finger 34 that is adapted for engaging one of the openings 14 of the interlock switch 10. The bent configuration of the first member 22 allows the safety lock 20 to conform at least partially to the exterior of the interlock switch 10. That is, the first member 22 conforms to one or more exterior corners of the interlock switch 10 by wrapping or otherwise bending around one or more faces of the interlock switch 10. Having adjacent sections of the first member parallel to and abutting different faces of the interlock switch 10 with an included corner sets up a mechanical interference between the interlock switch 10 and the safety lock 20 in terms of attempting to remove the safety lock 20, assuming that the safety lock 20 is engaged with the switch actuator opening(s) 14 of the interlock switch 10 and locked into place.

Those skilled in the art will appreciate that the fingers of the safety lock 20 (e.g., fingers 26 and 34) generally are designed to engage corresponding switch actuator openings 14 on the interlock switch head 12. Thus, the finger design may be varied to suit different styles of openings 14. For the horizontally slotted openings 14 illustrated in FIG. 1, the fingers generally will be flat and have the same horizontal orientation. However, the fingers may be cylindrical for circular switch actuator openings 14, or "L" shaped, or angled, or adapted in some other way to suit the particulars of the interlock switch 10. Note, too, that switch actuators often are "keyed" according to some profile, and the fingers of the safety lock 20 can be made "blank," so that their insertion does not actuate the interlock switch 10. Additionally, or alternatively, one or more of the fingers of the safety lock 20 can be made such that their insertion depth is sufficient for secure engagement but insufficient for switch actuation.

With these variations in mind, in at least one embodiment, the second member 24 is slidably coupled to first member 22, e.g., the first section 28 of the first member 22 may be configured to slidably retain the second member 24. With this configuration, the second member 24 slides between a first, disengaged position and a second, engaged position. Thus, in one or more embodiments, the first member 22 is configured to slidably retain the second member 24. The second member 24 is movable between an engaged position in which it engages a first one of the switch actuator openings 14 of the interlock switch 10, and a disengaged position in which it disengages from that first one of the switch actuator openings 14.

Notably, the second section 30 of the first member 22 or a junction area of the first and second sections 28 and 30, respectively, of the first member 22 includes a member opening through which the second member at least partially projects when the second member is slid into the engaged position. The opening may be a slot, notch, void, or other such feature as is appropriate for allowing the second member 24 to project at least partially through the first member 22 when the second member 24 is moved into its engaged position.

With such engagement in mind, one sees that to securely mount the safety lock 20 onto the interlock switch 10, one positions the second member 24 in its disengaged position, which, with reference to FIG. 1, allows the first member 22 to be placed onto the interlock switch 10, with finger 34 of the first member 22 "dropped" into a first switch actuator opening 14-1 of the switch head 12. Once the first member 22 is so positioned, the second member 24 is slid into the engaged position, which pushes finger 26 at least partially into a second switch actuator opening 14-2 of the switch head 12. In this manner, fingers 26 and 34 engage different openings 14 on different faces of the switch head 12.

Figure 3:
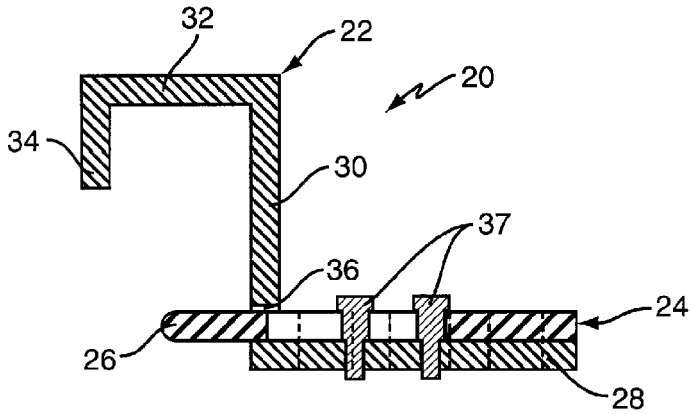
FIG. 3 is a diagram providing cross-sectional details for the side view of FIG. 2.

FIG. 3 provides additional relevant details for this configuration. For example, one sees a slot 36 (in cross-section), which allows at least a portion of the second member 24 to project through the first member 22, so that finger 26 slides into engagement with the switch actuator opening 14-2. FIG. 3 also illustrates connecting hardware 37, which may be captive to the safety lock 20, and which slidably retains the second member 24 on the first member 22.

Thus, in the illustrated embodiment of the safety lock 20, one sees that the first and second members 22 and 24 of the safety lock 20 are attached together by the connecting hardware 37, allowing them to move in relationship with each other. The illustrated embodiment provides for linear sliding motion of the second member 24 relative to the first member 22. Further, the first and second members 22 and 24 each have an engagement finger for engaging different openings 14 of the switch head 12. Note that safety lock 20 can be configured such that the length (depth) and offset or height of these fingers (26 and 34) is appropriate for the particular dimensions and configuration of the switch 10, and that different safety locks 20 can be made for different sizes of switches and/or for different makes and models of switches.

Figure 4:
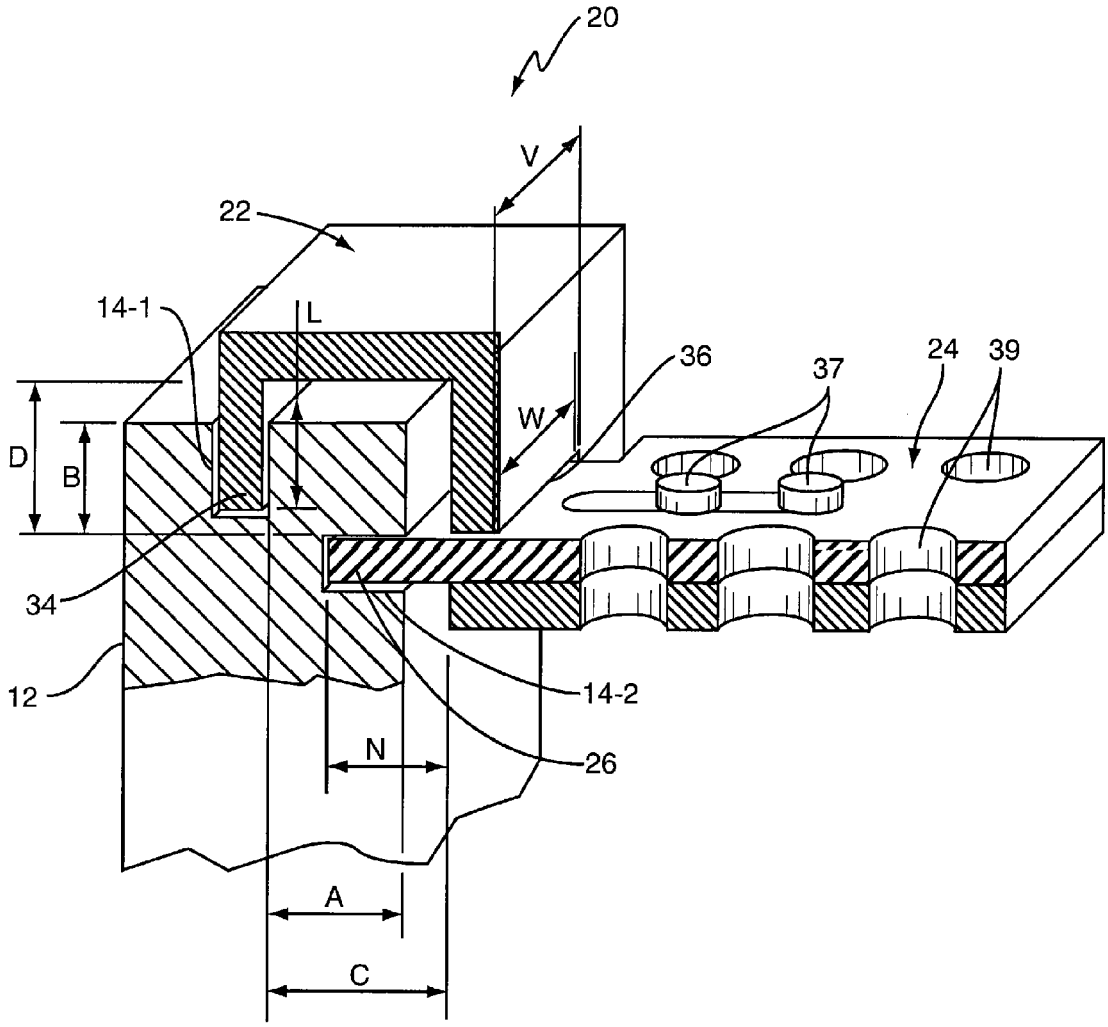
FIG. 4 is a perspective view of a safety lock mounted on an interlock switch.

In terms of proportioning the safety lock 20, the following relationships, as shown in FIG. 4, provide broad ("universal") adaptability to a broad range of switch dimensions and switch opening locations:

A—The distance from the Front Surface of the Safety Interlock Switch Head 12 to the Top Entry Switch Actuator Opening 14-1.

B—The distance from the Top Surface of the Safety Interlock Switch Head 12 to the Front Entry Switch Actuator Opening 14-2.

C—The distance from the Wall on the First Member 22 to the Top Entry Switch Actuator Opening 14-1 in the Safety Interlock Switch Head 12.

D—The distance from the First Member 22 to the Front Entry Switch Actuator Opening 14-2 in the Safety Interlock Switch Head 12.

L—The length of the Retainer Portion (finger 34) of the First Member 22.

N—The length of the Retainer Portion (finger 26) of the Second Member 24.

V—The width of the Openings 14 in the Safety Interlock Switch Head 12.

W—The width of the Retainer Portions (fingers 26 and 34) of the Main Members 22 and 24.

Wherein W<V min, C>A max, D>B max, L>(D-B) max, and N>(C-A) max. Of course, the safety lock 20 may be configured according to other proportions as needed or desired. (Note that in any of the embodiments taught herein, one or more of the switch actuator openings 14 may simply be engagement openings, to provide for secure engagement with the safety lock 20.)

Figure 5:
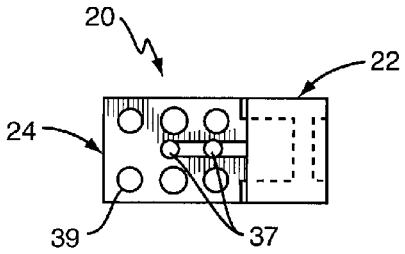
FIGS. 5-10 are various side, top, and perspective views of a safety lock mounted on an interlock switch.
Figure 6:
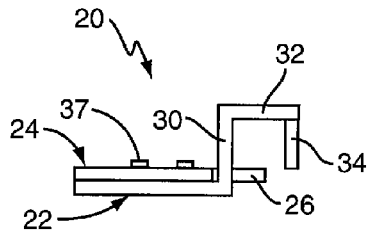
Figure 7:
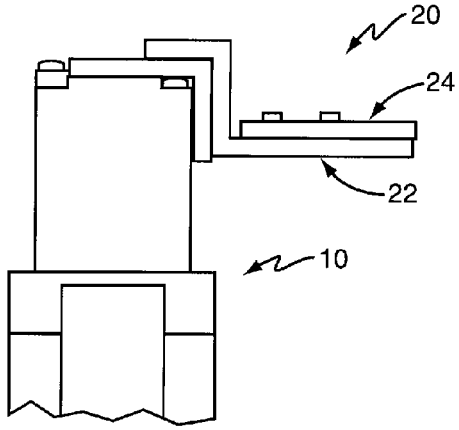
Figure 8:
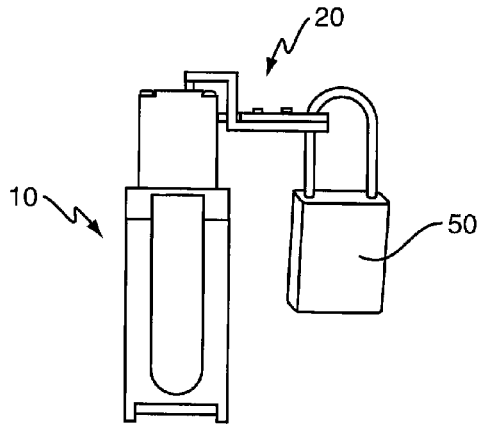
Figure 9:
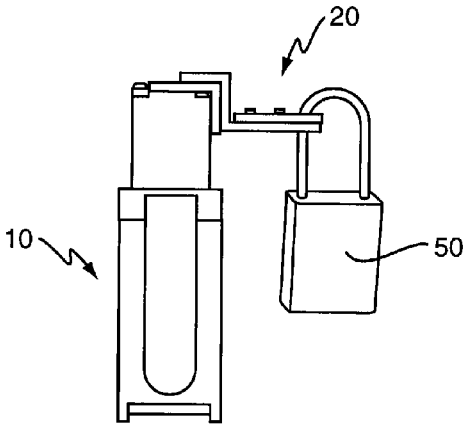
Figure 10:
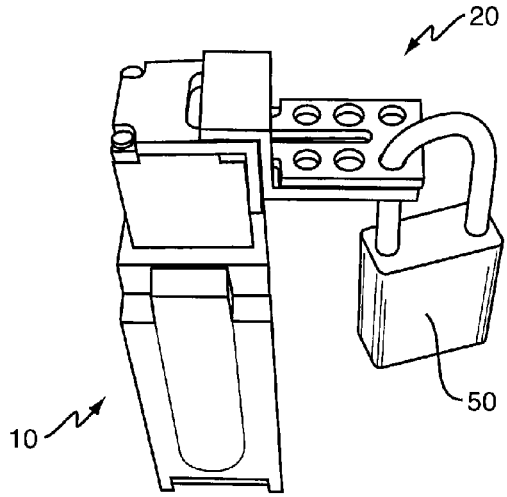

In any case, FIGS. 5 through 10 provide additional illustrations for the safety lock 20. For example, FIG. 5 provides a top view of the safety lock 20, wherein one sees corresponding lock openings 39 (e.g., holes) in the first and second members 22 and 24 that are brought into alignment when the second member 24 is moved into the engaged position. This alignment of lock openings allows one to lock the second member 24 into place, via a padlock or other locking device. That is, with the safety lock 20 mounted on the interlock switch 10, the second member 24 can be slid into engagement and locked into that position. Various ones of the remaining FIGS. 6-10 illustrate the use of a padlock 50 for this purpose.

Figure 11:
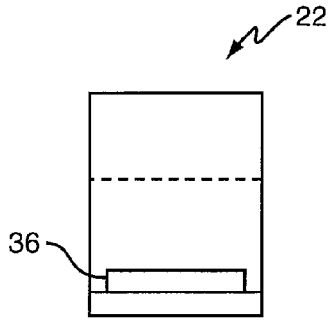
FIG. 11 is a diagram illustrating cutout (pass-through) details for a safety lock.
Figure 12:
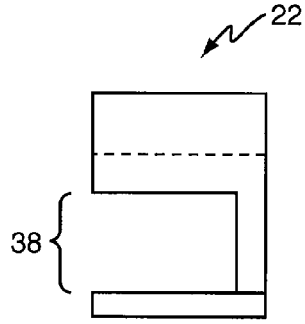
FIG. 12 is a diagram illustrating cutout/inset details for a safety lock.

Looking at further details and opportunities for variation, FIG. 11 illustrates a back view of the first member 22 of the safety lock 20 of FIG. 2. The second member 24 is removed to reveal the opening 36 that allows the finger 26 of the second member 24 to be slid into engagement with the corresponding switch actuator opening 14 of the interlock switch head 12. FIG. 12 illustrates one of several alternatives to forming an enclosed opening in the first member 22, wherein the first member 22 is formed with an inset or notch 38 in the (vertical) section 30 of the first member 22.

Figure 13:
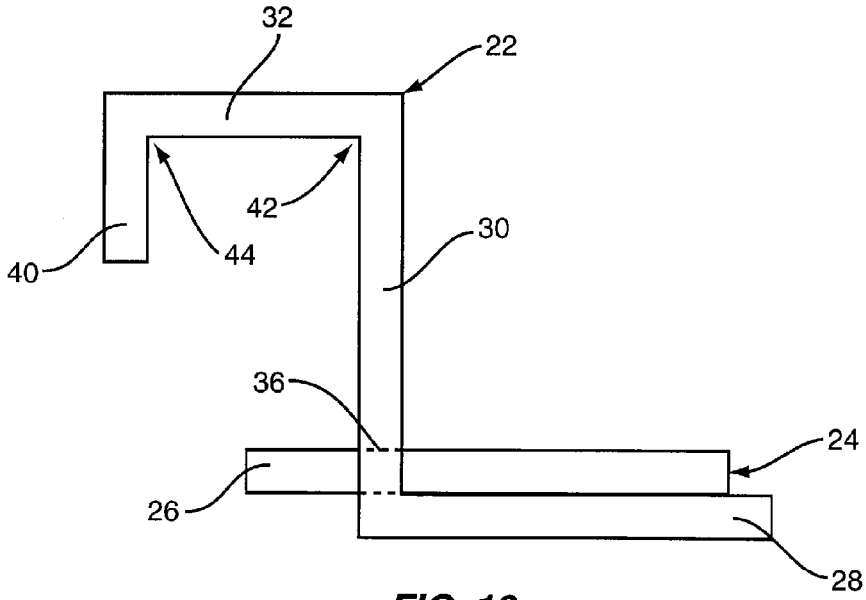
FIG. 13 is a diagram of a side view of another embodiment of safety lock.

FIG. 13 illustrates another embodiment of the safety lock 20, wherein the third (top) section 32 is extended to span the top surface of the switch head 12, and a fourth section 40 of the first member 22 extends perpendicularly downward from the third section in parallel with the back face of the switch head 12. (For perspective, in FIG. 1, the top face of the switch head 12 includes the switch actuator opening 14-1, the front face includes the switch actuator opening 14-2, and the back face includes the switch actuator opening 14-3.)

With this illustrated arrangement, the interior corners 42 and 44 formed by sections 30, 32, and 40 of the first member 22 wrap around the two exterior corners of the switch head 12. Thus, it may not be necessary for the first member 22 to include an engaging finger, because the mechanical interference associated with this wrap-around configuration prevents removal of the safety lock 20 from the switch 10, assuming that the finger 26 of the second member 24 has been moved into engagement with the corresponding switch actuator opening 14 of the switch head 12 and locked into place with the first member 22.

Figure 14:
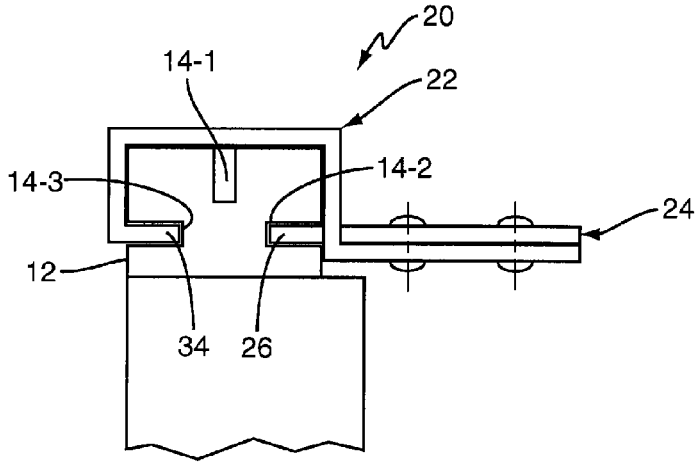
FIG. 14 is a diagram of a side view of another embodiment of safety lock.

FIG. 14 illustrates another embodiment, wherein the first member 22 is configured to wrap around the exterior of the switch 10, such that the finger 26 of the second member 24 engages the switch actuator opening 14-2 on the front face of the switch head 12 and the finger 34 of the first member 22 engages the switch actuator opening 14-3 on the back face of the switch head 12. In this configuration, the safety lock 10 does not engage the switch actuator opening 14-1 on the top face of the switch head 12.

Figure 15:
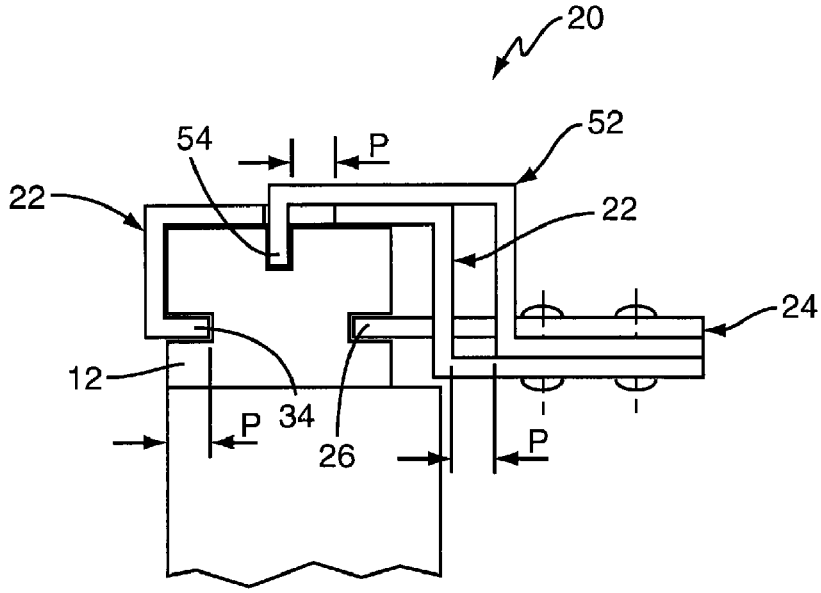
FIG. 15 is a diagram of a side view of another embodiment of safety lock.

However, FIG. 15 illustrates yet another configuration of the safety lock 20, wherein openings 14-1, 14-2, and 14-3 are engaged. The first member 22 extends over the top of the switch head 12 as in the embodiment of FIG. 14, and, too, its finger 34 engages the switch actuator opening 14-3 on the back face of the switch head 12. Additionally, however, a third member 52 includes an engagement finger 54 that is adapted for engaging the switch actuator opening 14-1 on the top face of the switch head 12, and the second member 24 engages the switch actuator opening 14-2 on the front face of the switch head 12 via the finger 26. Note that the first member 22 can be configured to include a pass-through opening for the finger 54 and that the second member 24 may slidably pass through the third member 52. Finally, note that the same three-opening engagement may be obtained by making the finger portion of the first member 22 detachable or at least movable, so that the switch lock 20 can be mounted and all three fingers 26, 34, and 54 are engaged with their corresponding openings 14 of the switch head 12.

Figure 16:
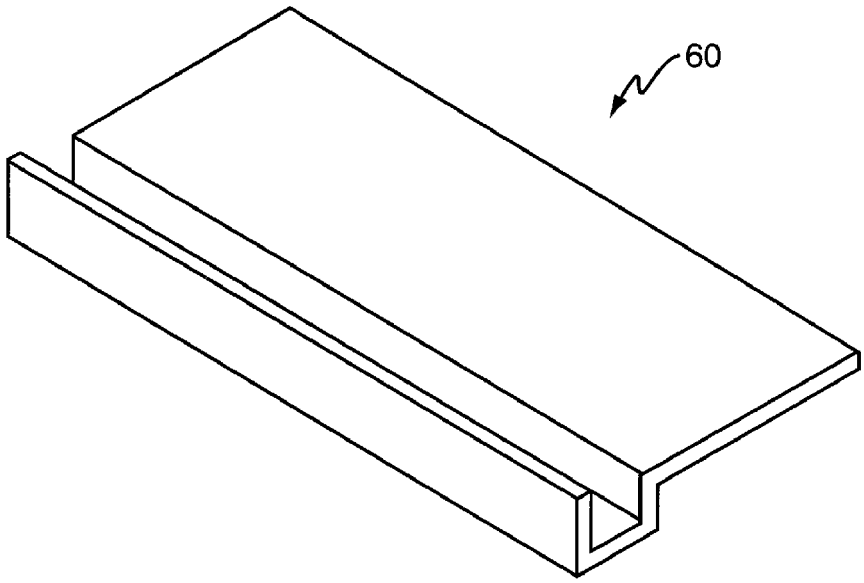
FIGS. 16-19 are diagrams related to another embodiment of safety lock.
Figure 17:
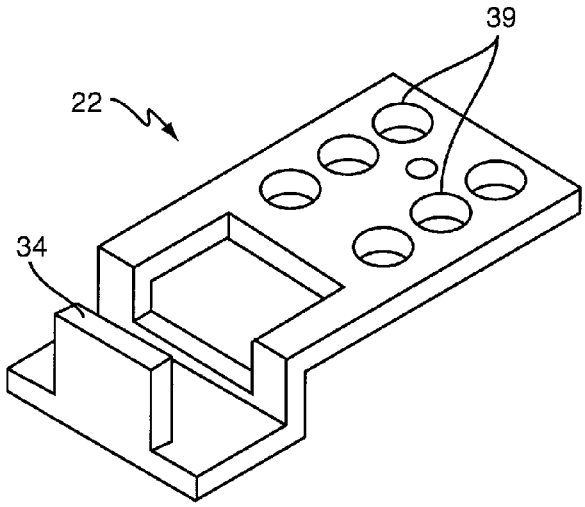
Figure 18:
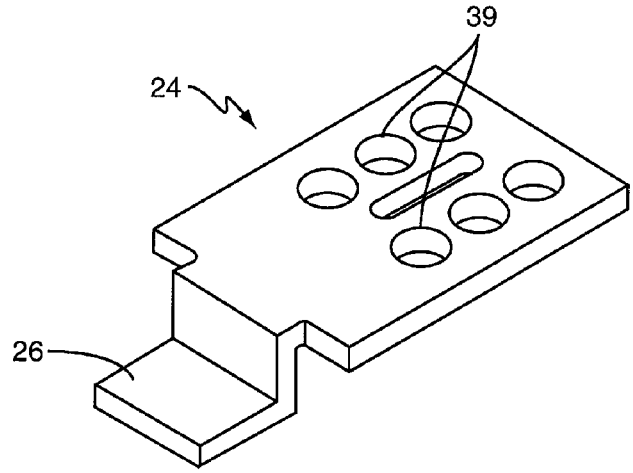

FIG. 16 illustrates an extruded member 60 from which the first and second members 22 and 24 of the safety lock 20 can be conveniently and economically machined. FIG. 17 illustrates one embodiment of the first member 22 as machined from a section of the extruded member 60. Similarly, FIG. 18 illustrates a complementary embodiment of the second member 24 as machined from another section of the extruded member 60.

Figure 19:
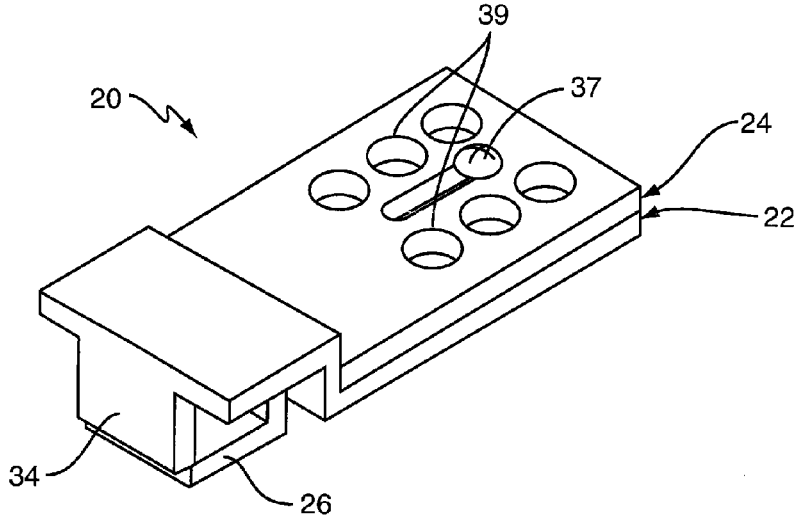

One sees that formation of the finger 34 of the first member 22 and the finger 26 of the second member 24 are part of the machining process. Thus, as shown in FIG. 19, the two machined members 22 and 24 mate together with connecting hardware 37 to form the assembled safety lock 20. Of course, the extrusion profile may be changed for different embodiments of the safety lock 20 and, in some embodiments, it may be necessary to use different extrusions for the first and second members 22 and 24.

With these and other variations in mind, one or more embodiments of the safety lock 20 as taught herein offer a number of advantages. By way of non-limiting example, these advantages include the fact that the openings 14 can be at any relative position to each other; for pass-through configurations of the first and second members 22 and 24, the safety lock 20 cannot be removed from force applied in angular motion, because of the pass through arrangement and because of the engagement of the finger 34 with the switch actuator opening 14-1 and of the finger 26 with the switch actuator opening 14-2, the same safety lock 20 can be used to lockout similar interlock switches 10 with different dimensions.

With the above range of variations in mind, it should be understood that the present invention is not limited by the foregoing description, nor is it limited by the accompanying drawings. Instead, the present invention is limited only by the following claims, and their legal equivalents.

What is claimed is:

1. A safety lock configured to lockably mount to an interlock switch, the safety lock comprising:

a first member configured to conform at least partially to a profile of the interlock switch; and a second member lockable to the first member in an engaged position, wherein the second member engages a first switch actuator opening in the interlock switch.

2. The safety lock of claim 1, wherein the first member comprises one or more plate sections that are bent or otherwise angled to span at least one exterior corner of the interlock switch.

3. The safety lock of claim 2, wherein a terminal one of the one or more plate sections includes or otherwise integrates an engaging finger to engage a second switch actuator opening in the interlock switch, wherein the first and second switch actuator openings are disposed in different faces of the interlock switch, such that the safety lock engages at least two faces of the interlock switch when mounted to the interlock switch.

4. The safety lock of claim 1, wherein the second member is slidably coupled to the first member and configured to slide between a disengaged position and the engaged position.

5. The safety lock of claim 4, wherein the first and second members include corresponding lock openings that are configured to align with each other when the second member is in its engaged position, thereby allowing the second member to be locked into the engaged position.

6. The safety lock of claim 1, wherein the interlock switch includes a second switch actuator opening, and wherein the first member is configured to engage the second switch actuator opening in the interlock switch and the second member and, when moved into an engaged position, the second member is configured to engage the first switch actuator opening in the interlock switch.

7. The safety lock of claim 6, wherein the first member is configured to span one or more included corners between first and second faces of the interlock switch, and wherein the first switch actuator opening is disposed on one of the first and second faces of the interlock switch and the second switch actuator opening is disposed in the other one of the first and second faces.

8. The safety lock of claim 6, wherein the first member slidably retains the second member, and wherein the second member is configured to be slid into the engaged position.

9. The safety lock of claim 8, wherein the first and second members include corresponding lock openings that align when the second member occupies the engaged position, thereby allowing the second member to be locked to the first member in the engaged position.

10. The safety lock of claim 1, wherein the first member comprises a first section on which the second member is slidably retained, a second section perpendicular to the first section that is configured to abut a first face of the interlock switch, and a third section perpendicular to the second section and parallel to the first section that is configured to abut a second face of the interlock switch.

11. The safety lock of claim 10, wherein the third section includes an engagement finger configured to engage a second switch actuator opening in the second face of the interlock switch.

12. The safety lock of claim 1, wherein the first member comprises a first section, a second section perpendicularly extending from an end of the first section, and a third section perpendicularly extending from an end of the second section, such that the first and third sections are in parallel and perpendicularly extend in opposite directions from respective ends of the second section.

13. The safety lock of claim 12, wherein the first member further comprises a fourth section perpendicularly extending from an end of the third section, such that the fourth section is parallel to the second section and spaced apart from the second section as a function of the third section's length.

14. A safety lock for lockably mounting to an interlock switch that includes one or more switch actuator openings, the safety lock comprising:

a first member configured to slidably retain a second member;

said second member movable between an engaged position in which the second member engages a first switch actuator opening of the interlock switch, and a disengaged position in which the second member disengages from the first switch actuator opening.

15. The safety lock of claim 14, wherein the first member is configured to to wrap around at least one corner of the interlock switch.

16. The safety lock of claim 14, wherein the first member comprises first, second, and third sections, wherein the first section is disposed at one end of the second section and projects perpendicularly away from the second section, and the third section is disposed at the other end of the second section and projects perpendicularly away from the second section in a direction opposite the first section.

17. The safety lock of claim 16, wherein the first section of the first member slidably retains the second member and the second section of the first member or a junction area of the first and second sections of the first member includes a member opening through which the second member at least partially projects when the second member is slid into the engaged position.

18. A method of safety locking an interlock switch comprising:

engaging at least two faces of the interlock switch with a first member that is angled or otherwise bent to wrap around the at least two faces of the interlock switch;

inserting a second member through an opening in the first member, such that the second member engages a first switch actuator opening disposed in a first one of the at least two faces of the interlock switch; and locking the second member to the first member in the engaged position.

19. The method of claim 18, wherein engaging at least two faces of the interlock switch with a first member that is angled or otherwise bent to wrap around the at least two faces of the interlock switch includes inserting an engagement finger of the first member into a second switch actuator opening disposed in a second one of the at least two faces of the interlock switch.

* * * * *